US006250582B1

(12) United States Patent
Conrad et al.

(10) Patent No.: US 6,250,582 B1
(45) Date of Patent: Jun. 26, 2001

(54) ROLL WINDING DEVICE AND METHOD

(75) Inventors: Hans-Rolf Conrad, Dormagen; Josef Kohnen, Tönisvorst, both of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/353,338

(22) Filed: Jul. 15, 1999

(30) Foreign Application Priority Data

Jul. 17, 1998 (DE) ..... 198 32 213

(51) Int. Cl.[7] ..... B65H 18/26
(52) U.S. Cl. ..... 242/541.7
(58) Field of Search ..... 242/541.7, 541.4, 242/541.5, 541.6, 542, 534

(56) References Cited

U.S. PATENT DOCUMENTS

| | | | | |
|---|---|---|---|---|
| 3,497,151 | | 2/1970 | Voss et al. . | |
| 5,441,213 | | 8/1995 | Graham | 242/534.2 |
| 5,823,463 | * | 10/1998 | Fissmann et al. | 242/541.7 |
| 5,829,709 | * | 11/1998 | Dorfel | 242/541.7 |
| 5,855,337 | * | 1/1999 | Schonmeier et al. | 242/541.7 |
| 5,924,647 | | 7/1999 | Dorfel | 242/542 |
| 5,996,926 | * | 12/1999 | Dorpczynski | 242/541.7 |

FOREIGN PATENT DOCUMENTS

| | | |
|---|---|---|
| 1047001 | 12/1958 | (DE) . |
| 1111496 | 7/1961 | (DE) . |
| 19524905 | 1/1987 | (DE) . |
| 4026597 | 2/1992 | (DE) . |
| 9201791 | 5/1992 | (DE) . |
| 9414449 | 2/1996 | (DE) . |
| 0863097 | 9/1998 | (EP) . |
| 92/03366 | 3/1992 | (WO) . |

* cited by examiner

*Primary Examiner*—John M. Jillions
(74) *Attorney, Agent, or Firm*—Greenblum & Bernstein, P.L.C.

(57) ABSTRACT

Roll winding device and method. The roll winding device has two carrying rollers defining a winding bed adapted to receive a wound roll. Each roller has a respective longitudinal axis, the longitudinal axes being substantially parallel to one another. The device includes a pressure chamber arrangement having opposed sides, opposed ends and a bottom, each side being defined by a respective carrying roller, the bottom being defined by a sealing body, and an end wall present at each opposed end. At least one end wall is a mobile end wall that is adapted to move along an an axis substantially parallel to the longitudinal axes of the carrying rollers. Also provided is a roll winding method for use with a roll winding device.

31 Claims, 1 Drawing Sheet

ROLL WINDING DEVICE AND METHOD

CROSS-REFERENCE TO RELATED APPLICATIONS

The present application claims priority under 35 U.S.C. § 119 of German Patent Application No. 198 32 213.5, filed on Jul. 17, 1998, the disclosure of which is expressly incorporated by reference herein in its entirety.

BACKGROUND OF THE INVENTION

1. Field of the Invention

The present invention relates to a roll winding device and method, and more particularly to a device and method using two carrying rollers which form a winding bed for receiving a wound roll.

2. Discussion of Background Information

A known roll winding device is discussed in German Patent Document No. DE 195 24 905 A1.

In one of the last production steps of producing paper webs, paper webs are usually cut to a desired width and then wound into rolls before they are packaged and shipped. The winding cores onto which the paper rolls are wound have a relatively low stiffness and carrying capacity, in contrast to the drums used during paper production. These cores are often cardboard tubes. As a result, paper rolls usually have to be supported by supporting rollers during the winding process. This is especially pronounced when the winding device is a carrying roller winder. In such a configuration, the roll rests on carrying rollers without any additional supporting devices acting on the core. But even in a supporting roll winder, where additional supporting devices act on the roll core, support is provided by a roller.

When the paper rolls become larger and thus heavier, the support line forces of the paper roll on the support roller or rollers become relatively large which has the disadvantage of causing winding hardness to increase. This winding hardness often causes the roll to split open later. To reduce the burden on the rolls and to reduce the line forces, pneumatic overpressure can be produced under the roll so that the roll is at least partially resting on an air cushion.

This measure is generally effective. However, a relatively large amount of air is needed to lessen the weight burden on the roll. With roll widths that change often, a relatively large amount of air escapes at the end regions. It is possible to reduce this loss of air by axially dividing the pressure chamber (i.e., parallel to the carrying rollers), into several sections and only providing air to the sections that are completely covered by the wound roll. However, this arrangement often leads to insufficient support from pressurized air in the edge regions of the wound roll. Also, if pressurized air is also provided to the areas that are not completely covered by the wound roll, a considerable loss of air will still occur.

SUMMARY OF THE INVENTION

The present invention provides a roll winding device and method. The roll winding device has two carrying rollers defining a winding bed adapted to receive a wound roll. Each roller has a respective longitudinal axis, the longitudinal axes being substantially parallel to one another. The device includes a pressure chamber arrangement having opposed sides, opposed ends and a bottom, each side being defined by a respective carrying roller, the bottom being defined by a sealing body, and an end wall present at each opposed end. At least one end wall is a mobile end wall adapted to move along an axis substantially parallel to the longitudinal axes of the carrying rollers.

The pressure chamber arrangement may be defined by two immobile end walls, and the mobile end wall may be present intermediate the two immobile end walls. Also, each immobile end wall may be present on a respective end of the sealing body. The device may alternatively include at least two mobile end walls each adapted to axially move in opposite directions relative to the axial center of the pressure chamber arrangement.

An air supply inlet located proximate the axial center of the pressure chamber arrangement may also be provided. Additionally, a plurality of air supply inlets adapted to discharge into the pressure chamber arrangement may be provided, and at least two of the air supply inlets may be adapted to be opened and closed. These air supply inlets may be actuated by one of the mobile end wall and a control device adapted to control the mobile end wall.

The mobile end wall may further include a sealing screen on an upper edge thereof, the sealing screen located in the winding bed. A sensor adapted to sense the wound roll may be located on the sealing screen. The sensor may be connected to an end wall driving device.

The roll winding method for use with the above roll winding device, may include moving the mobile end wall along an axis substantially parallel to the longitudinal axes of the carrying rollers.

The method may further include axially moving the mobile end walls in opposite directions relative to the axial center of the pressure chamber arrangement.

The method may additionally include discharging the air supply inlets into the pressure chamber arrangement and performing at least one of opening and closing of at least two of the air supply inlets. The at least two air supply inlets may be actuated by one of the mobile end wall and a control device adapted to control the mobile end wall.

A further method of winding a roll with the roll winding device may include placing an empty winding core in the winding bed, driving the winding core by the rotation of the two carrying rollers, pressing the winding core against the two carrying rollers and winding a material web about the rotating winding core. Each mobile end wall may be axially moved toward the axial center of the pressure chamber arrangement when the web roll has reached a predetermined size, until the sensor senses the ends of the roll. Pressurized air may be provided to the area defined by the carrying rollers, the sealing body, and the mobile end walls.

The present invention decreases air usage by including at least one end wall movable in a direction parallel to the axial direction of the carrying rollers.

The end wall can be adjusted so that a pressure chamber has the same axial length as the wound roll. Therefore, pressurized air is provided only along the axial length that is necessary to support the wound roll. No air cushion is created in areas located axially outside the wound roll. Therefore, no air is provided that can escape from this region. However, support from pressurized air is provided axially over the entire length inside the wound roll (i.e., where the wound roll rests on the carrying rollers). The end wall only needs to be moved proximate an end of the roller to delimit the pressure chamber. While a hermetic seal is not possible, the remaining gaps or holes are considerably smaller than the areas of known pressure chamber arrangements, which are not covered by the wound roll but were still provided with air.

A sealing body beneath the carrying rollers is usually an air receiver (i.e., it not only has a base plate, but it also has side walls) which axially extends proximate carrying rollers. Such an arrangement allows for control of the mobile end wall. It is also possible to construct the sealing body as a simple plate. The mobile end wall can be controlled on this simple plate or in another manner.

Preferably, a pressure chamber arrangement has two immobile end walls, between which at least one mobile end wall is arranged. The two immobile end walls give the pressure chamber arrangement stability. Not only do the immobile end walls limit the movement of the mobile end wall to prevent it from accidentally being moved out of the pressure chamber arrangement, but they also can be used to support driving elements for the mobile end wall. In addition, the immobile end walls limit axial pressure losses in the pressure chamber arrangement.

Each immobile end wall is preferably arranged on a respective end of the sealing body. A conventional air receiver may be used that extends across the entire axial length of the roll winding device (i.e., practically the entire axial length of the carrying rollers). Mobile end walls can then be used in such an air receiver.

Advantageously, at least two mobile end walls may be provided, which can be moved in opposite directions relative to an axial center of the pressure chamber arrangement. It is thus always possible to symmetrically position the wound roll and/or a "stack" of wound rolls on the carrying rollers, and still have the advantages of a precisely adjusted pressure chamber for pressurized air support of the wound rolls.

Preferably, an air supply inlet may be provided proximate the axial center of the pressure chamber arrangement. The symmetrical adjustability of both end walls ensures that the air can always be supplied in the area between both mobile end walls, thereby allowing elaborate control measures to be omitted.

Preferably, several air supply inlets, at least some of which can be sealed, communicate with the pressure chamber arrangement. Having several air supply inlets is advantageous in that the air that is supplied is opposed by a lower flow resistance. The air can also be distributed quickly in the pressure chamber, where cross-flows in the pressure chamber may be kept low. These air losses are kept low because the air supply inlets that are not needed may be closed off. Thus, air is supplied only by the air supply inlets that discharge into an area that is covered by the wound roll.

It is preferred that the air supply inlets that can be closed off can be activated by a mobile end wall or by a device that controls the end wall. When the mobile end wall passes one of the air supply inlets, it opens the air supply inlet as it moves in one axial direction and closes it as it moves in the other axial direction. Thus, adjustment is automatic, and the operator or operating device no longer needs to ensure that the air supply inlets that are not needed are closed off. This opening and closing occurs automatically through the positioning of the mobile end wall or walls.

The mobile end wall may have a sealing screen on its top side, which is located in the winding bed. This arrangement has several advantages. This arrangement facilitates positioning when setting the proper position for the mobile end wall relative to an end of the wound roll. An operator can see with the naked eye where the mobile end wall is located, because it is shown by the sealing screen. The operator thus need only move the sealing screen into the immediate vicinity of the end of the wound roll to position the mobile end wall so that the pressure chamber has the correct axial extension.

Also, the sealing screen seals the end of the roll so that air usage remains low in this region. The seal is not hermetic, because the wound roll needs to rotate during winding. However, the sealing screen keeps air losses within tolerable limits. Because the sealing screen is connected to the end wall, separate positioning of the sealing screen is no longer necessary, which would otherwise add an extra step to the process. This arrangement drastically simplifies the adjustment of the winding device during winding.

It is necessary when winding a roll, to adjust the sealing screen or to move it onto the end of the winding roll. This necessity arises because the roll core of the winding roll or of a "stack" of winding rolls must be axially guided, at least at the beginning of the winding process. The corresponding guide, which is inserted axially into the roll cores, needs a certain amount of space, so no end facing sealing screens can be used at the beginning of the winding process. Also, the screen is necessary because pressurized air support is not yet needed at the beginning of the winding process. It is desirable at the beginning of the winding process to have a relatively high roll hardness. The pressurized air support only becomes necessary with large roll diameters, such as those in the range of about 800 mm. However, the diameter depends on, among other things, the specific characteristics of the material web, for example, the paper web, to be wound.

A sensor may be arranged on the sealing screen that monitors the wound roll. This kind of sensor provides data as to whether the sealing screen is close enough to the end of the wound roll or whether it is still somewhat too far away. The sensor can operate in contact with the roll (e.g., as a limit switch), or it can operate as a proximity sensor without being in contact with the roll.

The sensor may be connected to a mobile end wall driving device. In this arrangement, the positioning of the end wall may occur automatically. The driving device may axially move the end wall until the sensor reports a sufficient proximity to the end of the paper roll.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of certain embodiments of the present invention, in which like numerals represent like elements throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 2:
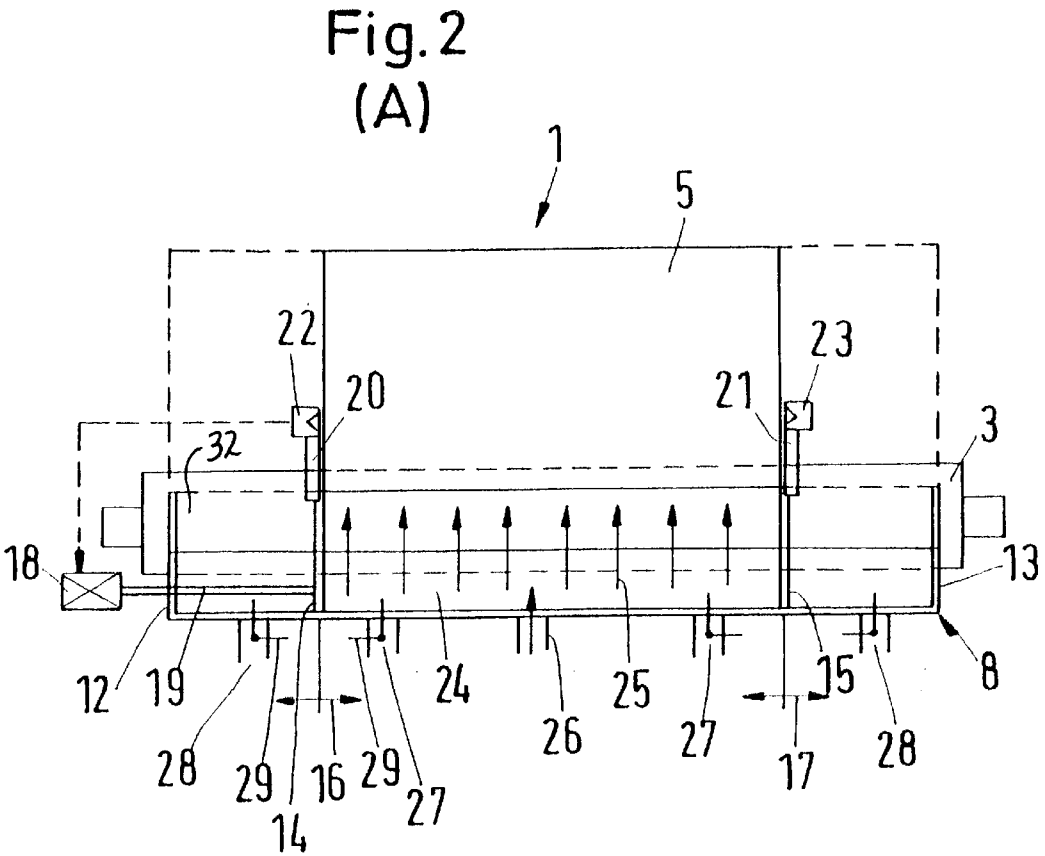
FIG. 2 shows a sectional view of the present invention cut along line A—A of FIG. 1.
Figure 1:
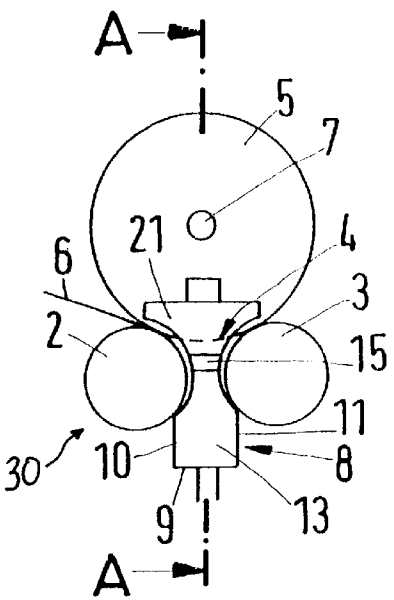
FIG. 1 shows a schematic frontal view of a web roll winding device according to the present invention.

Referring to the drawings wherein like numerals represent like elements, FIGS. 1 and 2 show a winding device 1 having two carrying rollers 2 and 3 which form a winding bed 4 on which a paper roll 5 rests. A paper web 6 may be wound onto the paper roll 5. The paper web 6 is initially wound onto a core 7, which may be, but is not limited to, a cardboard winding core. In order to drive the paper roll 5, both carrying rollers 2 and 3 are driven by a driving mechanism (not shown).

A sealing body such as an air receiver 8 is present beneath the two carrying rollers 2 and 3 and beneath the winding bed 4 as a part of a pressurized air support device 30. In the present invention, the air receiver 8 has a generally U-shaped profile having a base 9 and two axially arranged side walls 10 and 11. The side walls 10 and 11 are respectively adjacent the carrying rollers 2 and 3. A small gap may be formed between a side wall 10, 11 and a carrying roller 2, 3 to allow the carrying rollers 2 and 3 to rotate without friction. As shown in FIG. 1, a pressure chamber arrangement is surrounded on the bottom by the base 9 of the air receiver 8, on the sides by the side walls 10 and 11 and the carrying rollers 2 and 3, and on top by the paper roll 5.

However, as can be seen in FIG. 2, the paper roll 5 does not extend along the entire axial length of the air receiver 8. The paper rolls are axially shorter. Instead of the single paper roll 5 shown, a number of paper rolls arranged coaxially and adjacent to one another could also rest on the carrying rollers 2 and 3 in alternative embodiments.

The air receiver 8 has opened ends, with an immobile end wall 12 and 13 on each of its ends. The space between the two immobile end walls 12 and 13 is described as a "pressure chamber arrangement 32." If the pressure chamber arrangement 32 were to be filled with pressurized air, a large portion of the pressurized air in the areas of the pressure chamber arrangement that are not covered by the paper roll 5 would escape.

In order to reduce this loss of air, two mobile end walls 14 and 15 are provided, each end wall being movable in the direction of a respective double arrow 16 and 17 parallel to the carrying rollers 2 and 3. For end wall 14, a drive 18, which can, for example, act on the end wall 14 via a rod 19 is provided. A corresponding drive (not shown) can also be provided for the other end wall 15. It is also possible for both end walls 14 and 15 to be activated by the same drive 18. The drive or drives (i.e., control device) 18 are controlled in such a way that they axially move the end walls 14 and 15 in opposite directions and therefore remain symmetrical to an axial center (not shown) of the winding device 1.

Each mobile end wall 14 and 15 is moved through the area between the two carrying rollers 2 and 3 and each has a respective sealing screen 20, 21 on an upper edge. Each sealing screen 20, 21 forms a small gap with a respective end of the paper roll 5. Complete surface contact between a sealing screen 20, 21 and an end of the paper roll 5 is not possible because the paper roll 5 rotates in order to wind the paper web 6. With the aid of the sealing screens 20, 21, however, a good seal is achieved and the air losses are kept to a minimum.

A respective sensor 22, 23 is located on each sealing screen 20, 21. The sensor 22, 23 is preferably a proximity sensor, and emits a signal when a sealing screen 20, 21 has reached a predetermined distance from the end of the paper roll 5, such as approximately 0.5 mm or 1 mm. When this distance is reached, the sensor 22 sends a signal to drive 18, which ceases to move the end wall 14 closer to the paper roll 5.

A pressure chamber 24 is located between the two mobile end walls 14 and 15. Arrows 25 show that the air of the pressure chamber 24 is blown toward the paper roll 5 in order to create pressurized air, which supports the paper roll 5.

A number of air supply inlets 26–28 are provided to allow the necessary air to be transported into the pressure chamber 24 with as little resistance as possible. The air supply inlets 26–28 are provided. Here, air supply inlet 26, which is arranged in the axial center, is permanently open. Air supply inlets 27 and 28, which are arranged axially farther outwards from the center toward the respective ends of the paper roll, may be closed with the aid of a valve or flap. Each valve (not shown in detail), has an actuation element 29 that closes the valve when the mobile end wall 14, 15 passes over it in one direction and opens the valve when the mobile end wall 14, 15 passes over it in the other direction. This can be seen in FIG. 2 from the different positions of the actuation elements 29 for the air supply inlets 27 and 28. For example, if the mobile end walls 14 and 15 are moved toward the axial center, the air supply inlet 27 would be closed.

The operation of the winding device 1 will now be described. An empty winding core 7 is laid in the winding bed 4 and is driven by the rotation of the two carrying rollers 2 and 3. A pressing device (not shown) presses the winding core 7 against the carrying rolls 2 and 3 with a predetermined force in order to achieve a greater winding hardness at the beginning of the winding process. The paper web 6 is wound by the rotation of the winding core 7.

The winding core 7 is held in place in the axial direction by known means, in order to prevent unwanted movement in the axial direction.

When the paper roll 5 has reached a certain size, for example, when its diameter has grown to about 800 mm, the mobile end walls 14 and 15 are moved toward the respective ends of the paper roll 5 by the drive 18 until the sensors 22 and 23 report that the sealing screens 20 (and therefore also the end walls 14 and 15) have reached the respective ends of the paper roll 5, whereupon the pressure chamber 24 can be provided with pressurized air.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A roll winding method for use with a roll winding device, the roll winding device having two carrying rollers defining a winding bed adapted to receive a wound roll, each roller having a respective longitudinal axis, the longitudinal axes being substantially parallel to one another, the roll winding device further having a pressure chamber arrangement having opposed sides, opposed ends and a bottom, each side being defined by a respective carrying roller, the bottom being defined by a sealing body, an end wall present at each opposed end, and at least two mobile end walls located intermediate the end walls, the roll winding device still further having a sensor adapted to sense the ends of the wound roll, the method comprising:

placing an empty winding core in the winding bed;

driving the winding core by the rotation of the two carrying rollers;

pressing the winding core against the two carrying rollers;

winding a material web about the rotating winding core;

axially moving each mobile end wall toward the axial center of the pressure chamber arrangement, when the web roll has reached a predetermined size, until the sensor senses the ends of the roll; and providing the area defined by the carrying rollers, the sealing body, an the mobile end walls with pressurized air.

2. The roll winding method according to claim 1, said axially moving of each mobile end wall comprising axially moving each mobile end wall in opposite directions relative to the axial center of the pressure chamber arrangement.

3. The roll winding method according to claim 1, further comprising an air supply inlet located proximate the axial center of the pressure chamber arrangement.

4. The roll winding method according to claim 1, further comprising a plurality of air supply inlets, wherein said providing the area defined by the carrying rollers, the sealing body, and the mobile end walls with pressurized air further comprises performing at least one of opening and closing of at least two of the air supply inlets.

5. The roll winding method according to claim 4, further comprising actuating at least one of the at least two air supply inlets using one of the mobile end walls.

6. The roll winding method according to claim 1, wherein at least one mobile end wall further comprises a sealing screen on an upper edge thereof, the sealing screen being located in the winding bed.

7. The roll winding method according to claim 6, wherein the sensor is located on the sealing screen.

8. The roll winding method according to claim 7, further comprising an end wall driving device, wherein the sensor is connected to the end wall driving device.

9. A roll winding device, comprising:

two carrying rollers defining a winding bed adapted to receive a winding roll;

each said carrying roller having a respective longitudinal axis, said longitudinal axes being substantially parallel to one another;

a pressure chamber arrangement having opposed sides, opposed ends and a bottom;

each said side being defined by a respective carrying roller;

said bottom being defined by a sealing body;

an end wall disposed at each said opposed end;

a plurality of air supply inlets that are adapted to discharge into said pressure chamber arrangement, at least two of said air supply inlets being adapted to be opened and closed, at least one said end wall being a mobile end wall that is adapted to move along an axis substantially parallel to said longitudinal axes of said carrying rollers, wherein at least one of said at least two of said air supply inlets are adapted to be opened and closed, and wherein at least one of said at least two air supply inlets is adapted to be actuated by said mobile end wall.

10. A roll winding device, comprising:

two carrying rollers defining a winding bed adapted to receive a winding roll;

each said carrying roller having a respective longitudinal axis, said longitudinal axes being substantially parallel to one another;

a pressure chamber arrangement having opposed sides, opposed ends and a bottom;

each said side being defined by a respective carrying roller;

said bottom being defined by a sealing body;

an end wall disposed at each said opposed end, at least one said end wall being a mobile end wall that is adapted to move along an axis substantially parallel to said longitudinal axes of said carrying rollers;

said mobile end wall further comprising a sealing screen on an upper edge thereof, said sealing screen being located in said winding bed; and a sensor located on said sealing screen and adapted to sense the wound roll.

11. The roll winding device according to claim 10, further comprising an end wall driving device, wherein said sensor is connected to said end wall driving device.

12. A roll winding method for use with a roll winding device, the roll winding device having two carrying rollers defining a winding bed adapted to receive a wound roll, each roller having a respective longitudinal axis, the longitudinal axes being substantially parallel to one another, the roll winding device further having a pressure chamber arrangement having opposed sides, opposed ends and a bottom, each side being defined by a respective carrying roller, the bottom being defined by a sealing body, an end wall present at each opposed end, wherein at least one end wall is a mobile end wall, and a plurality of air supply inlets, the method comprising:

moving the mobile end wall along an axis substantially parallel to the longitudinal axes of the carrying rollers;

discharging the air supply inlets into the pressure chamber arrangement;

performing at least one of opening and closing of at least two of the air supply inlets; and actuating at least one of the at least two air supply inlets using one of the mobile end walls.

13. A roll winding method for winding a roll on a roll winding device, the roll winding device having two carrying rollers defining a winding bed adapted to receive a wound roll, each roller having a respective longitudinal axis, the longitudinal axes being substantially parallel to one another, the roll winding device further having a pressure chamber arrangement having opposed sides, opposed ends and a bottom, each side being defined by a respective carrying roller, the bottom being defined by a sealing body, an end wall present at each opposed end, wherein at least one end wall is a mobile end wall, the mobile end wall further comprising a sealing screen on an upper edge thereof, the sealing screen being located in the winding bed, and a sensor located on the sealing screen and adapted to sense the wound roll, the method comprising:

positioning the roll in the winding bed adjacent the pressure chamber arrangement;

moving the mobile end wall along an axis substantially parallel to the longitudinal axes of the carrying rollers;

sensing the roll with the sensor; and winding the roll in the winding bed.

14. A roll winding device, comprising:

two carrying rollers defining a winding bed adapted to receive a winding roll;

each said carrying roller having a respective longitudinal axis, said longitudinal axes being substantially parallel to one another;

a pressure chamber arrangement having opposed sides, opposed ends and a bottom;

each said side being defined by a respective carrying roller;

said bottom being defined by a sealing body;

an end wall disposed at each said opposed end, at least one said end wall being a mobile end wall that is adapted to move along an axis substantially parallel to said longitudinal axes of said carrying rollers; and said pressure chamber arrangement further including two immobile end walls, wherein said at least one mobile end wall is disposed intermediate said two immobile end walls.

15. The roll winding device according to claim 14, wherein each said immobile end wall is present on a respective said end of said sealing body.

16. The roll winding device according to claim 14, wherein at least one said mobile end wall is at least two mobile end walls each adapted to axially move in opposite directions relative to the axial center of said pressure chamber arrangement.

17. The roll winding device according to claim 16, further comprising an air supply inlet located proximate the axial center of the pressure chamber arrangement.

18. The roll winding device according to claim 14, further comprising a plurality of air supply inlets that are adapted to discharge into said pressure chamber arrangement, wherein at least two of said air supply inlets are adapted to be opened and closed.

19. The roll winding device according to claim 18, wherein said at least two of said air supply inlets that are adapted to be opened and closed, are adapted to be actuated by one of said mobile end wall and a control device adapted to control said mobile end wall.

20. The roll winding device according to claim 14, wherein said mobile end wall further comprises a sealing screen on an upper edge thereof, said sealing screen being located in said winding bed.

21. The roll winding device according to claim 20, further comprising a sensor located on said sealing screen and adapted to sense the wound roll.

22. The roll winding device according to claim 21, further comprising an end wall driving device, wherein said sensor is connected to said end wall driving device.

23. A roll winding method for winding a roll on a roll winding device, the roll winding device having two carrying rollers defining a winding bed adapted to receive a wound roll, each roller having a respective longitudinal axis, the longitudinal axes being substantially parallel to one another, the roll winding device further having a pressure chamber arrangement having opposed sides, opposed ends and a bottom, each side being defined by a respective carrying roller, the bottom being defined by a sealing body, an end wall present at each opposed end, wherein at least one end wall is a mobile end wall, and the pressure chamber arrangement is defined by two immobile end walls, wherein the at least one mobile end wall is present intermediate the two immobile end walls, the method comprising:

positioning the roll in the winding bed adjacent the pressure chamber arrangement;

moving the mobile end wall along an axis substantially parallel to the longitudinal axes of the carrying rollers;

winding the roll between the two immobile end walls in the winding bed.

24. The roll winding method according to claim 23, wherein each immobile end wall is present on a respective end of the sealing body.

25. The roll winding method according to claim 23, wherein at least one end wall is at least two mobile end walls, the method further comprising axially moving the mobile end walls in opposite directions relative to the axial center of the pressure chamber arrangement.

26. The roll winding method according to claim 25, further comprising an air supply inlet located proximate the axial center of the pressure chamber arrangement.

27. The roll winding method according to claim 23, further comprising a plurality of air supply inlets, the method further comprising:

discharging the air supply inlets into the pressure chamber arrangement; and performing at least one of opening and closing of at least two of the air supply inlets.

28. The roll winding method according to claim 27, further comprising actuating at least one of the at least two air supply inlets using one of the mobile end walls.

29. The roll winding method according to claim 23, wherein the mobile end wall further comprises a sealing screen on an upper edge thereof, the sealing screen being located in the winding bed.

30. The roll winding method according to claim 29, further comprising a sensor located on the sealing screen and adapted to sense the wound roll.

31. The roll winding method according to claim 30, further comprising an end wall driving device, wherein the sensor is connected to the end wall driving device.

* * * * *